United States Patent [19]

Baker et al.

[11] Patent Number: 4,581,836

[45] Date of Patent: Apr. 15, 1986

[54] FIRING PIN AND FIRING PIN-BUSHING ASSEMBLY

[75] Inventors: Richard L. Baker, Granby, Conn.; Gary A. Sniezak, Agawam, Mass.

[73] Assignee: Bangor Punta Corporation, Greenwich, Conn.

[21] Appl. No.: 516,834

[22] Filed: Jul. 25, 1983

[51] Int. Cl.[4] ..... F41C 1/00

[52] U.S. Cl. ..... 42/65; 42/69 R

[58] Field of Search ..... 42/59, 65, 66, 67, 69 R, 42/69 A, 69 B, 41, 42 R, 42 A; 89/155, 127.11, 27.14

[56] References Cited

U.S. PATENT DOCUMENTS

| | | | |
|---|---|---|---|
| 235,240 | 12/1880 | Hood | 42/65 X |
| 376,922 | 1/1888 | Smith | 42/65 |
| 3,050,894 | 8/1962 | Ivy | 42/69 R |
| 3,696,543 | 10/1972 | Kennedy et al. | 42/67 |
| 3,708,902 | 1/1973 | Foster et al. | 42/69 R X |
| 4,067,131 | 1/1978 | Ruger et al. | 42/65 |
| 4,221,065 | 9/1980 | Curran | 42/65 |

FOREIGN PATENT DOCUMENTS

| | | | |
|---|---|---|---|
| 524187 | 11/1953 | Belgium | 42/65 |
| 2040772 | 2/1972 | Fed. Rep. of Germany | 42/69 R |

*Primary Examiner*—David H. Brown
*Assistant Examiner*—John E. Griffiths
*Attorney, Agent, or Firm*—Patrick J. Walsh

[57] ABSTRACT

Disclosed is an elongated, generally cylindrical, firing pin for a revolver, the firing pin having first and second end sections separated by an intermediate section. The first section terminates in a chisel tip for impacting a cartridge casing. The chiselled tip is characterized by bevelled sides and a bevelled bottom terminating in an asymmetrical tip end face. The firing pin is axially slidable in a bushing non-rotatably mounted in the revolver frame by a transverse bushing pin. A keyway system cooperates between the intermediate section of the firing pin and the bushing to preclude rotational movement of the firing pin relative to the bushing.

1 Claim, 3 Drawing Figures

FIRING PIN AND FIRING PIN-BUSHING ASSEMBLY

BACKGROUND OF THE INVENTION

The present invention relates to a firing pin for a revolver and particularly relates to a firing pin and firing pin-bushing assembly for use in a revolver.

Firing pins for use in revolvers have been utilized since the advent of revolvers themselves. Consistent and reliable firing performance over the life of the revolver is a primary criteria for the design of a firing pin and its assembly in a revolver frame. Many firing pins, however, erode with use to the point where it is problematical whether the revolver will fire. Another shortcoming of prior firing pins in their frequent tendency to stick in the case of the cartridge being fired. This can and does result in jamming the revolver. At the very least, it causes substantial wear on the tip of the firing pin. The design of a firing pin for a revolver must also take into consideration the requirement to fire both center fire and rim fire cartridges. Further, any improvement in a firing pin and its assembly in a revolver frame should provide for ready retrofitting of existing revolvers with the improved firing pin.

SUMMARY OF THE PRESENT INVENTION

Accordingly, it is a primary object of the present invention to provide a novel and improved firing pin for a revolver.

It is another object of the present invention to provide a novel and improved firing pin for a revolver wherein the shape of the tip of the firing pin is specifically designed to minimize or eliminate any tendency of the firing pin to stick in the casing of the cartridge upon firing the revolver.

It is another object of the present invention to provide a novel and improved firing pin for a revolver wherein the shape of the firing pin tip enables the firing pin to be readily, easily and quickly withdrawn from the cartridge casing thus minimizing or eliminating erosion of the tip of the firing pin caused by its projection into the cartridge casing and the firing of the cartridge.

It is a further object of the present invention to provide a novel and improved firing pin having the foregoing characteristics wherein the firing pin is useful for revolvers utilizing rim fire or center fire cartridges.

It is a still further object of the present invention to provide a novel and improved firing pin and firing pin-bushing assembly having novel and improved means for preventing rotation of the firing pin relative to the bushing housing the firing pin.

It is a related object of the present invention to provide a novel and improved firing pin and firing pin-bushing assembly which enables ready and east retrofitting of existing revolvers with the novel and improved firing pin and firing pin-bushing assembly hereof.

To achieve the foregoing objects and in accordance with the purpose of the present invention, as embodied and broadly described herein, a firing pin for a revolver according to the present invention comprises an elongated generally cylindrical body having first and second generally cylindrical sections at opposite ends thereof and a diametrically enlarged generally cylindrical intermediate section therebetween, the first section having a tip at an end thereof remote from the intermediate and second sections for striking a cartridge casing carried by the revolver, the tip being reduced along its opposite sides and bottom to define a generally planar tip end face lying in a plane generally normal to the axis of the cylindrical body and located non-symmetrically with respect to the cylindrical body axis, the second section being adapted to be struck by a hammer carried by the revolver to axially advance the firing pin to strike the cartridge casing.

Preferably, the sides and bottom of the firing pin tip are bevelled inwardly toward the axis of the firing pin and towards its end face to define a substantially rectangular tip end face in a plane normal to the body axis. Furthermore, a bushing is provided for housing the firing pin. Preferably, the bushing has a central generally cylindrical bore therethrough for receiving the firing pin and enabling axial displacement of the firing pin within the bushing, and means are provided cooperable between the firing pin and the bushing for preventing relative rotation therebetween substantially throughout the range of axial displacement of the firing pin within the bushing.

The invention consists in the novel parts, constructions, arrangements, combinations and improvements shown and described. The accompanying drawings, which are incorporated in and constitute a part of this specification, illustrate an embodiment of the present invention and, together with the description, serve to explain the principles of the invention.

BRIEF DESCRIPTION OF THE DRAWING FIGURES

FIG. 1 is a fragmentary vertical cross sectional view through the frame of a revolver and illustrating a novel and improved firing pin and firing pin-bushing assembly constructed in accordance with the present invention and illustrating the firing pin in its normal retracted position within the frame;

FIG. 2 is a fragmentary cross sectional view taken generally about on line 2—2 in FIG. 1 and illustrating the chisel tip of the firing pin; and FIG. 3 is a cross sectional view of the firing pin and firing pin-bushing assembly of FIG. 1 taken generally about on line 3—3 thereof and illustrating in accordance with the present invention a keyway system for preventing relative rotation between the firing pin and the bushing therefor.

DETAILED DESCRIPTION OF THE PRESENT INVENTION

Figure 1:
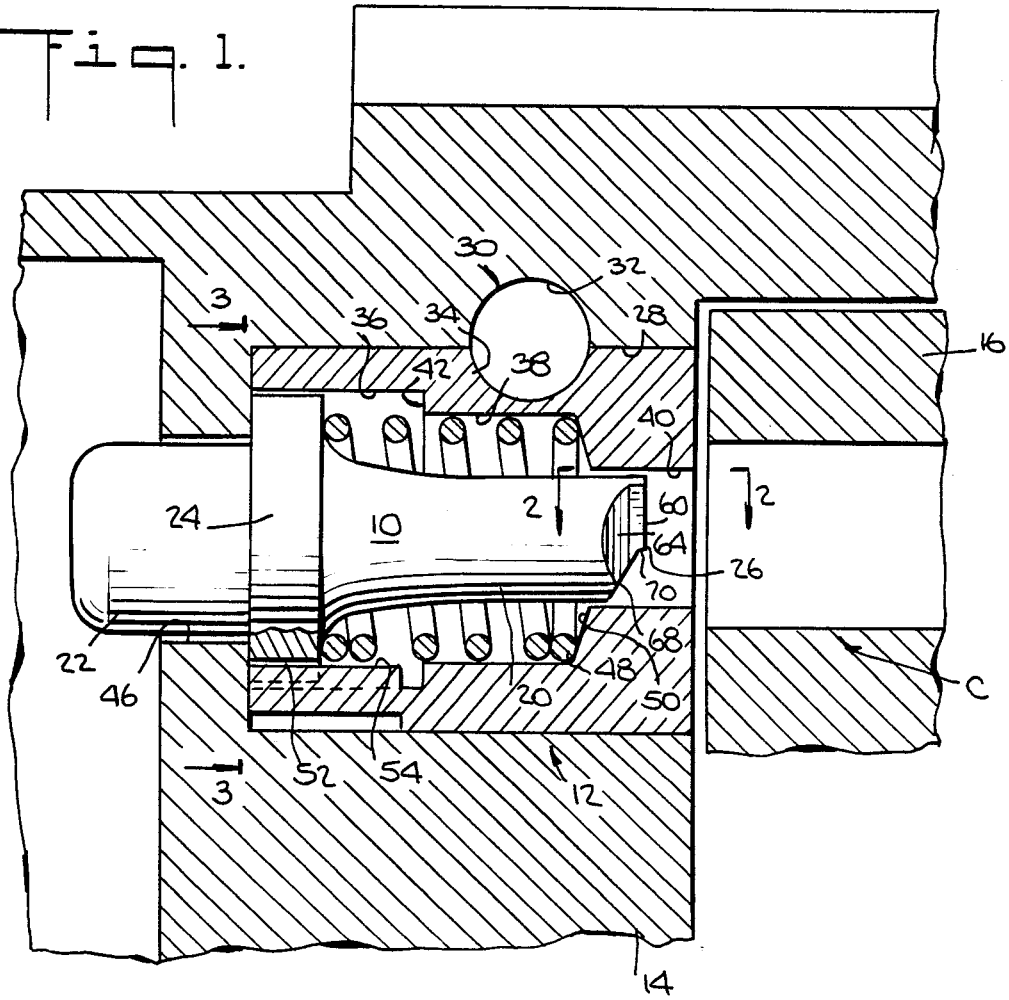

Referring now to FIG. 1, there is illustrated a firing pin and bushing therefor, constructed in accordance with the present invention, and generally designated 10 and 12, respectively. Firing pin 10 and bushing 12 are disposed in the frame 14 of a revolver R behind the cylinder 16 of revolver R. It will be appreciated that the cylinder of the revolver rotates to align successive cartridges C disposed in cylinder 16 in striking position in front of firing pin 10 such that the firing pin can be displaced forwardly toward cylinder 16 into engagement with the case of the cartridge casing to fire the cartridge. Thus, the operation of the revolver is conventional with the exception of the cooperation between the firing pin and bushing and the action of the firing pin per se upon striking the cartridge casing as will be described hereinafter.

Particularly, firing pin 10 is comprised of an elongated generally cylindrical body having first and second generally cylindrical sections 20 and 22, respectively, at opposite ends thereof with a diametrically enlarged generally cylindrical intermediate section 24 disposed therebetween. The forward end of the first firing pin section 20 terminates in a chisel tip 26, the precise shape of which is described in detail hereinafter. As illustrated in FIG. 1, the shaft of the first section 20 is reduced in diameter in comparison with the diameter of the second section 22.

Bushing 12 serves as a housing for firing pin 10. Particularly, bushing 12 is generally cylindrical and coextensive in length with and for reception in a cylindrical bore 28 in frame 14 of revolver R. A bushing pin 30 is disposed, in final assembly, in a transverse groove 32 in frame 14 and a transverse groove 34 formed along the outer face of bushing 12 in registry with groove 32. Thus, in final assembly, bushing 12 is locked to frame 14 against displacement axially out of frame bore 28 and against rotational movement relative to frame 14 by the bushing pin 30.

A cylindrical bore is formed through bushing 12 and includes stepped bores 36, 38, and 40, respectively, in order of decreasing diameter from the rear of bushing 12 axially toward its forward end adjacent cylinder 16. In assembly, the largest diameter bore 36 at the rear end of bushing 12 receives the enlarged intermediate section 24 of firing pin 10, bore 36 extending axially in a forward direction a distance equal to the length of travel of the firing pin in operation as will be described. The juncture of stepped bores 36 and 38 form an annular shoulder 42 which provides a stop for the intermediate section 24 of firing pin 10 as it is displaced forwardly upon firing revolver R. The smallest diameter 40 receives the first section 20 including chisel tip 26 of firing 10 for axial sliding movement relative thereto. The frame 14 includes a reduced diameter opening 46 at the rear end of bushing 12 for receiving the second section 22 of firing pin 10 enabling the latter to project rearwardly in the normal retracted position of the firing pin as illustrated to enable it to be struck by the hammer, not shown, of the revolver.

In assembly, a coil spring 48 is disposed in the bore of bushing 12 with the forward end of spring 48 butting the shoulder 50 defined between stepped bores 38 and 40. The rear end of spring 48 engages the forward annular face of intermediate section 24. Thus, coil spring 48 biases firing pin 10 for axial movement in a rearward direction and maintains the firing pin in the illustrated retracted position with the rear face of intermediate section 24 butting the portion of the frame 14 surrounding opening 46.

Figure 3:
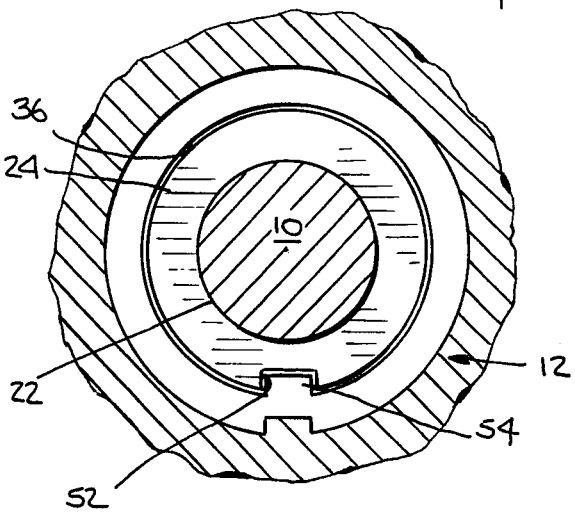

It will be appreciated from a review of FIGS. 1 and 3 that a keyway system is utilized to prevent firing pin 10 for rotating relative to bushing 12. Particularly, intermediate section 24 of firing pin 10 is provided with an axially extending groove or keyway 52. A radially inwardly directed key 54 extends axially along a side of stepped bore 36 and is received, in assembly, in keyway 52. Thus, firing pin 10 may be displaced axially within bushing 12 while key 54 and keyway 52 cooperate one with the other to prevent relative rotational movement of firing pin 10 and bushing 12.

Figure 2:
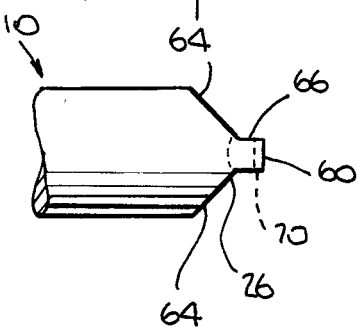

Referring now to FIGS. 1 and 2, the shape of chisel tip 26 at the end of firing pin 10 will now be described. Tip 26, as illustrated, is reduced; i.e., chiseled or bevelled, along its opposite sides and bottom to define a generally planar tip end face 60 lying in a plane generally normal to the axis of the cylindrical body of the firing pin and located non-symmetrically with respect to the cylindrical body axis. More particularly, each of the sides is reduced by forming a flat 64 which extends from a location set back from the tip end face of the firing pin, forwardly toward the tip end face and inwardly at an angle toward the axis of the firing pin. Each angled flat 64 terminates short of the axis of firing pin 10. Another flat 66 extends forwardly from flat 64 in an axial direction toward tip end face 60. Preferably, flats 64 at an angle of about 45 degrees relative to the axis of the firing pin and are symmetrically arranged on opposite sides of the firing pin. Also, flats 66 lie generally parallel to one another on opposite sides of the cylindrical body axis. The undersigned or bottom of chisel tip 26 is also reduced by forming a flat 68. Flat 68 extends from a location set back from the tip end face 60 at a sharp angle upwardly toward the axis of the firing pin and tip end face 60. Flat 68 terminates short of the axis of the firing pin, between the juncture of flats 64 and 66 and the tip end face 60, and then extends in an axial direction toward the tip end face to form a flat 70. From the foregoing description it will be seen that the tip 26 of firing pin 10 is non-symmetrical and is offset upwardly relative to the axis of firing pin 10.

In a preferred embodiment of the present invention, the axial lengths of the first, intermediate and second sections 20, 22, and 24 are 0.213, 0.047, and 0.118 inches, respectively, providing an overall firing pin length of 0.378 inches. The diameters of the first, intermediate, and second sections are 0.083, 0.172, and 0.123 inches, respectively. Each flat 64 subtends an angle of 45 degrees with respect to the axis of the firing pin while flat 68 subtends an angle of about 60 degrees with the axis of the firing pin. side flats 66 extend a distance 0.015 inches rearwardly from the tip end face 60 with flat 70 extending parallel to the firing pin axis a distance of about 0.008 inches normal to the firing pin axis and the plane of flat 70.

In use, spring 48 maintains the firing pin in its normal retracted position with the chisel tip 26 recessed rearwardly of the forward face of bushing 10. Upon firing the revolver, the second section is impacted by the hammer, not shown, to advance firing pin 10 against the bias of spring 48 such that chisel tip 26 impacts the base of the cartridge casing in cylinder 16. The bevelled side and bottom flats and the general configuration of chisel tip 26 enable the metal of the cartridge casing to be deformed laterally upon impact without sticking to the firing pin. This enables the spring 48 to immediately retract firing pin 10 from the cartridge casing without sticking thereto. Also, it minimizes or eliminates erosion of the firing pin tip. Because the axes of the firing pin and cartridge are alined one with the other, the area of impact of chisel tip 26 is sufficient to detonate both center or rim fire cartridges. It will be appreciated that both during advancement and retraction of the firing pin upon firing the revolver, the rotational orientation of the firing pin is maintained constant as a result of the cooperation between the key 54 of bushing 12 and keyway 52 of firing pin 10.

With the foregoing arrangement, retrofitting of existing revolver frames may be readily and easily accomplished simply by replacing the old bushing assembly with the aforedescribed bushing assembly. No new holes in or other working of the frame of the revolver is necessary.

It will be apparent to those skilled in the art that various modifications and variations could be made in the firing pin and firing pin-bushing assembly of the present invention without departing from the scope of spirit of the invention.

What is claimed is:

1. A firing pin assembly for a revolver comprising a firing pin having an elongated body having first and second generally cylindrical sections at opposite ends thereof and a diametrically enlarged generally cylindrical intermediate section therebetween arranged along an axis, said first section having a tip at an end thereof remote from said intermediate and second sections for striking a cartridge case carried by the revolver, said tip being defined by first a pair of bevelled flats symmetrically arranged on opposite sides of the firing pin and extending forwardly and inwardly toward the tip, terminating short of the axis and intersecting a second pair of flats, the second pair of flats extending forwardly from the intersections in an axial direction toward the tip and together with a portion of the outer surface of the first pin section defining said tip as being a planar tip end face, the underside of said firing pin having a bevelled flat set back from the end face and extending away from the axis, the tip end face as defined having a generally rectangular configuration, being nonsymmetrical and offset with respect to the axis, and a bushing for housing said firing pin, said bushing having a central bore therethrough for receiving said firing pin and enabling axial displacement thereof within said bushing, and a keyway carried by said firing pin, and a key carried by said bushing disposed within said keyway for preventing relative rotation therebetween substantially throughout the range of axial movement of said firing pin within said bushing, whereby said pin fires both rim and center fire cartridges without adjustment.

* * * * *